US005228150A

United States Patent [19]

Parker

[11] Patent Number: 5,228,150

[45] Date of Patent: Jul. 20, 1993

[54] PATIENT BATHING APPARATUS

[76] Inventor: Milton B. Parker, 306 W. Rose Valley Rd., Wallingford, Pa. 19086

[21] Appl. No.: 806,475

[22] Filed: Dec. 13, 1991

[51] Int. Cl.[5] ..... A47K 3/08

[52] U.S. Cl. ..... 4/568; 4/589; 4/573.1; 4/557; 239/558; 128/366; 128/375

[58] Field of Search ..... 4/538, 546, 557, 567, 4/568, 571.1, 573.1, 589, 536, 547, 596, 598, 601, 604, 621, 630, 30.2; 239/438, 443, 558; 128/365, 366, 402, 373, 375

[56] References Cited

U.S. PATENT DOCUMENTS

| | | | |
|---|---|---|---|
| 563,454 | 7/1896 | Cunningham | 239/443 |
| 1,143,822 | 6/1915 | Giedinghagen | 128/373 |
| 2,827,043 | 3/1958 | Wallin | 128/30.2 |
| 4,055,863 | 11/1977 | Duval | 4/567 |

*Primary Examiner*—Renee S. Luebke
*Assistant Examiner*—Charles R. Eloshway
*Attorney, Agent, or Firm*—Leon Gilden

[57] ABSTRACT

A patient bathing apparatus includes an upper and lower semi-cylindrical shell, wherein the shell is mounted to a matrix of nozzles respectively within each shell, the nozzles in fluid communication with a fluid source to direct a bathing spray onto a patient. A heater assembly is mounted at a rear distal end of the shells to direct heated drying air onto the patient subsequent to a bathing event. Valve means is provided within the lower shell to cease flow of water thereto to provide for spraying of a lower portion of an individual patient in situations limited to spraying a respective top or bottom surface of the patient only.

5 Claims, 4 Drawing Sheets

PATIENT BATHING APPARATUS

BACKGROUND OF THE INVENTION

1. Field of the Invention

The field of invention relates to bathing apparatus, and more particularly pertains to a new and improved patient bathing apparatus wherein the same permits the bathing of individuals of limited physical capacity.

2. Description of the Prior Art

Bathing apparatus is exemplified in U.S. Pat. No. 4,074,370 to Harmony wherein a bathing type tub is arranged in alignment relative to an adjacent hospital bed for ease of positioning and displacement of a patient to the bathing structure.

U.S. Pat. No. 4,713,850 to Flaherty, et al. sets forth a cart arranged to position an individual therewithin to permit bathing of the individual.

U.S. Pat. No. 4,545,083 to Searson sets forth a bathing spray including a series of channels to direct a spray from the plate structure.

U.S. Pat. No. 4,010,498 to Jablonski sets forth a bathtub utilizing an inner spray liner defined by a matrix of apertures directed through an inner wall of the bathtub structure.

As such, it may be appreciated that there continues to be a need for a new and improved patient bathing apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bathing apparatus now present in the prior art, the present invention provides a patient bathing apparatus wherein the same utilizes an encircling cylindrical vessel to contain an individual effecting bathing of the individual. As such, the general purpose of the present invention, which will be described subsequently in greater detail, is to provide a new and improved patient bathing apparatus which has all the advantages of the prior art bathing apparatus and none of the disadvantages.

To attain this, the present invention provides a patient bathing appratus including an upper and lower semicylindrical shell, wherein the shell is mounted to a matrix of nozzles respectively within each shell, the nozzles in fluid communication with a fluid source to direct a bathing spray onto a patient. A heater assembly is mounted at a rear distal end of the shells to direct heated drying air onto the patient subsequent to a bathing event. Valve means is provided within the lower shell to cease flow of water thereto to provide for spraying of a lower portion of an individual patient in situations limited to spraying a respective top or bottom surface of the patient only.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved patient bathing apparatus which has all the advantages of the prior art bathing apparatus and none of the disadvantages.

It is another object of the present invention to provide a new and improved patient bathing apparatus which may be easily and efficiently manufactures and marketed.

It is a further object of the present invention to provide a new and improved patient bathing apparatus which is of a durable and reliable construction.

An even further object of the present invention is to provide a new and improved patient bathing apparatus which is susceptible of a low cost manufacture with regard to both materials and labor, and which accordingly is then susceptible of low prices of sale to the consuming public, thereby making such patient bathing apparatus economically available to the buying public.

Still yet another object of the present invention is to provide a new and improved patient bathing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
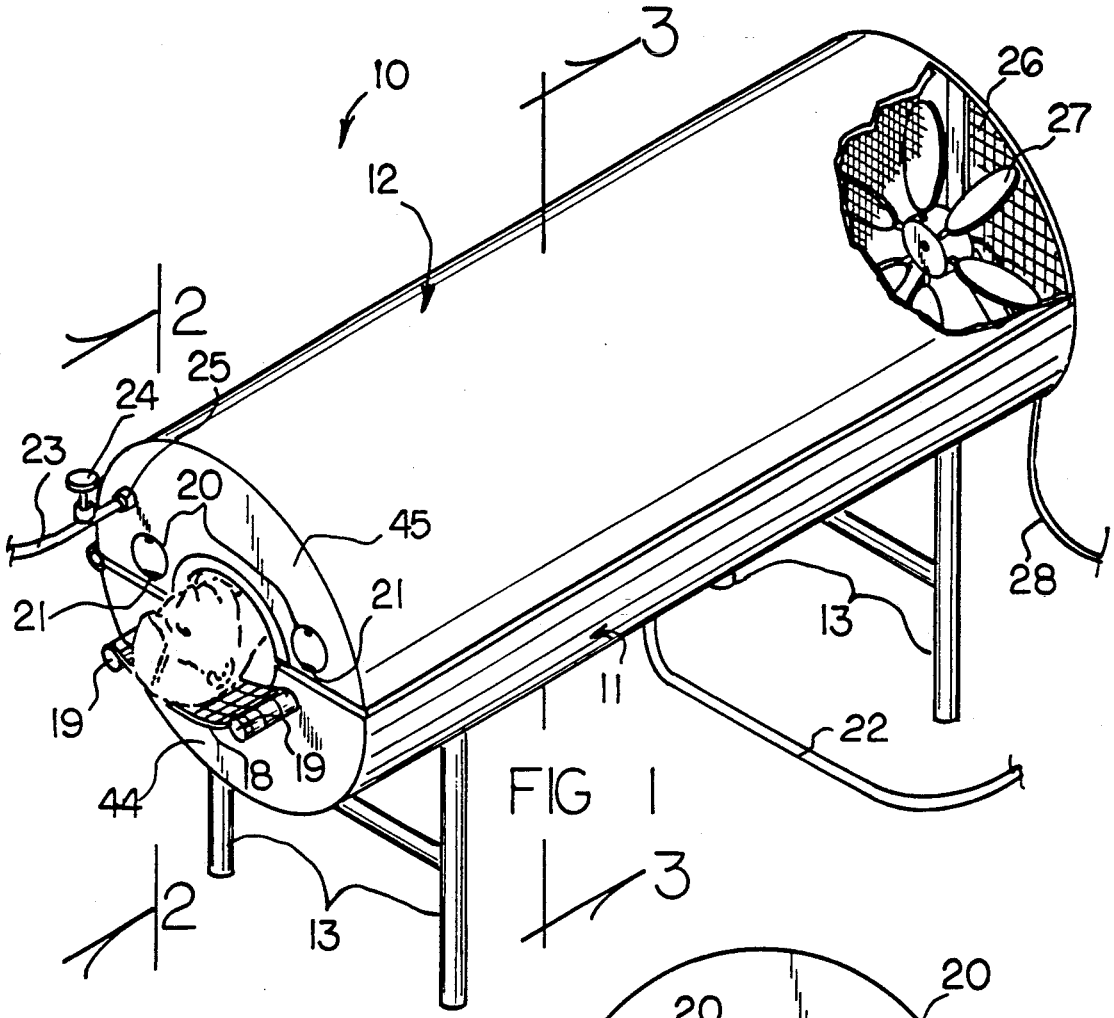
FIG. 1 is an isometric illustration of the instant invention.
Figure 2:
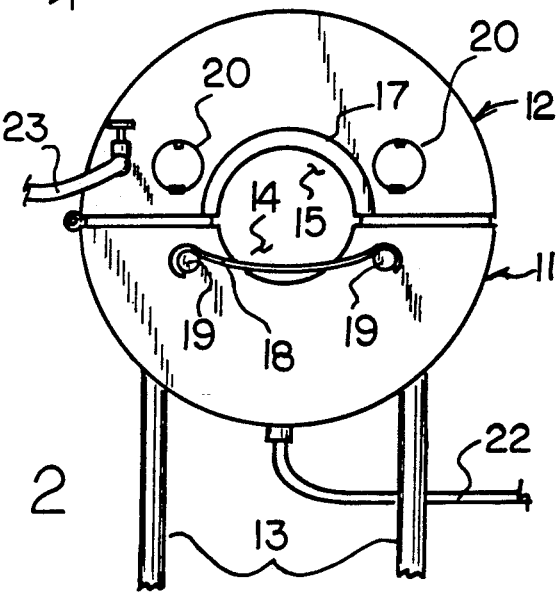
FIG. 2 is an orthographic view, taken along the lines 2—2 of FIG. 1 in the direction indicated by the arrows.
Figure 3:
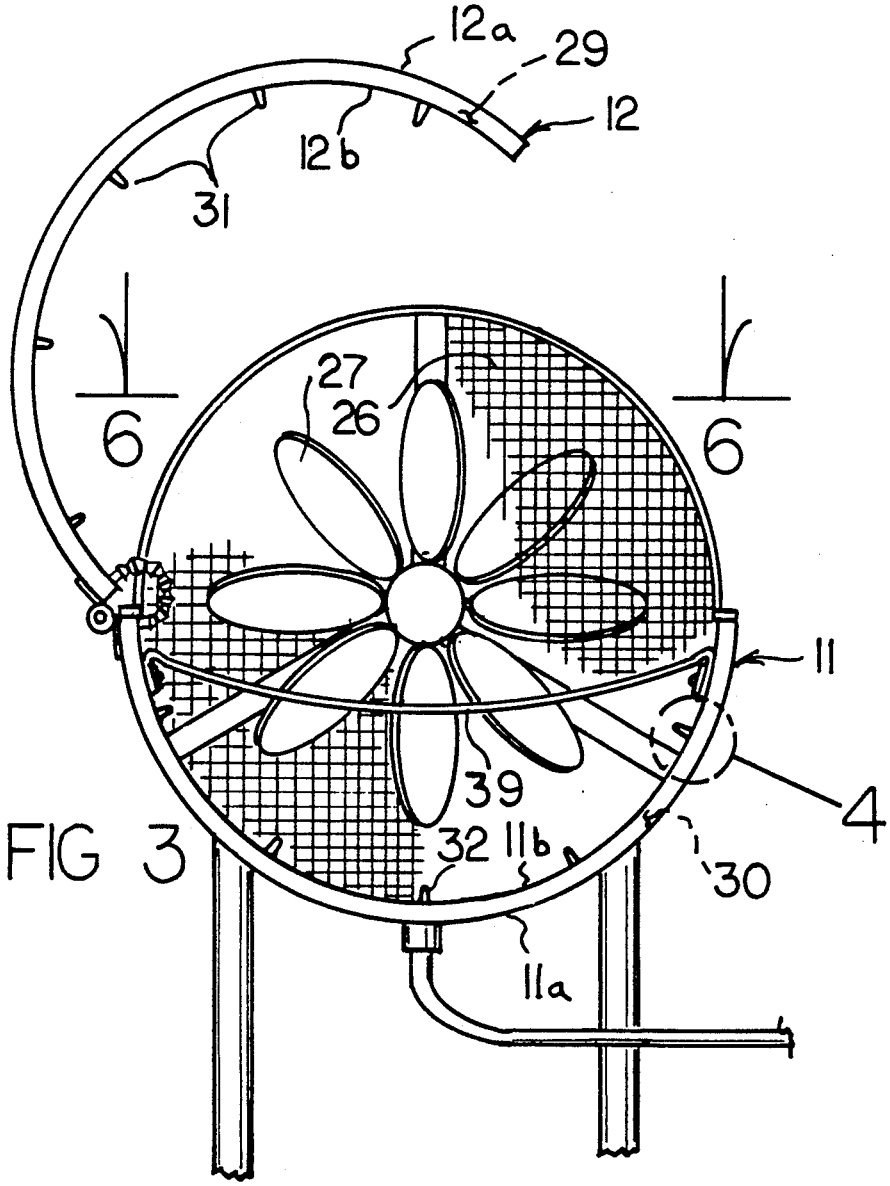
FIG. 3 is an orthographic view, taken along the lines 3—3 of FIG. 1 in the direction indicated by the arrows.
Figure 5:
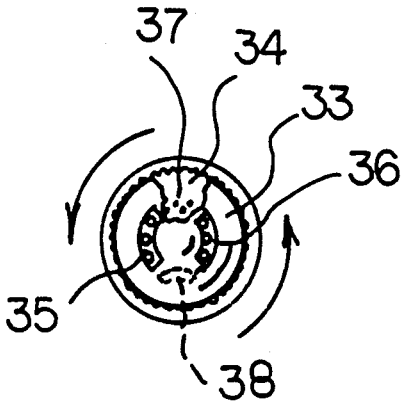
FIG. 5 is an top orthographic view, taken along the lines 5—5 of FIG. 4 illustrating the rotative adjustment of the nozzle structure of the invention.
Figure 4:
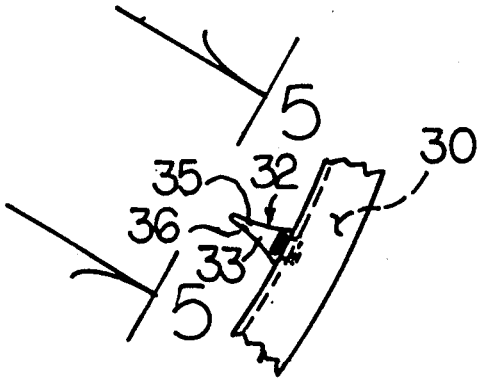
FIG. 4 is an enlarged orthographic view of section 4 as set forth in FIG. 3.
Figure 6:
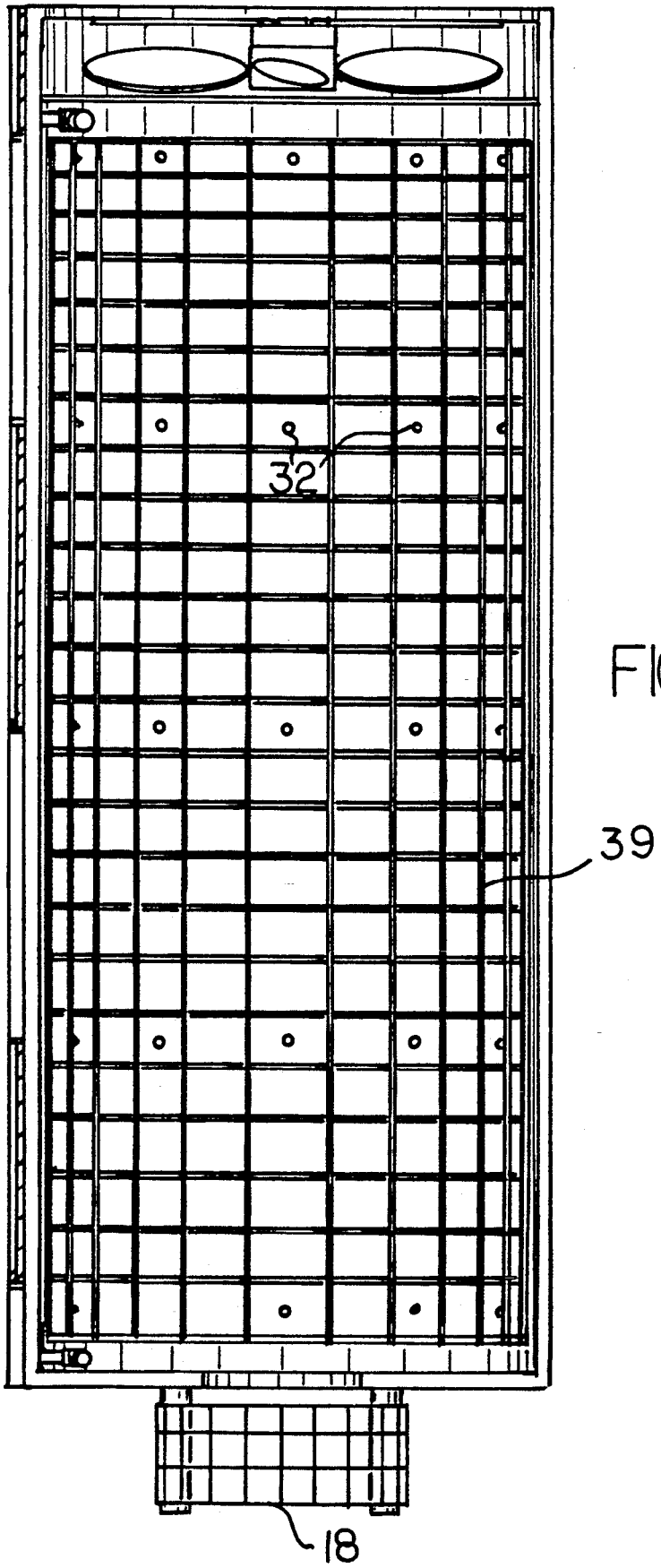
FIG. 6 is an orthographic view, taken along the lines 6—6 of FIG. 3 in the direction indicated by the arrows.

With reference now to the drawings, and in particular to FIGS. 1 to 8 thereof, a new and improved patient bathing apparatus embodying the principles and concepts of the present invention and generally designated by the reference numeral 10 will be described.

Figure 7:
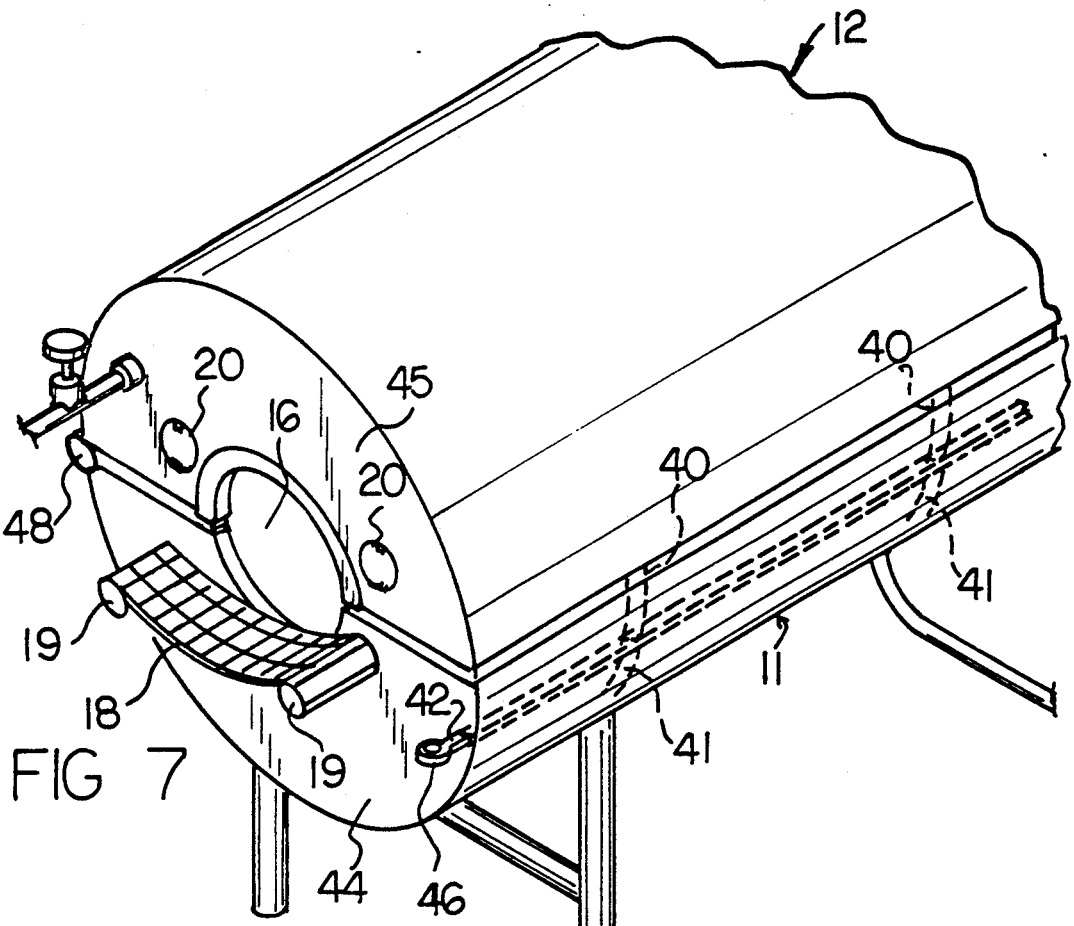
FIG. 7 is an isometric illustration setting forth a modification of the water flow structure of the invention.
Figure 8:
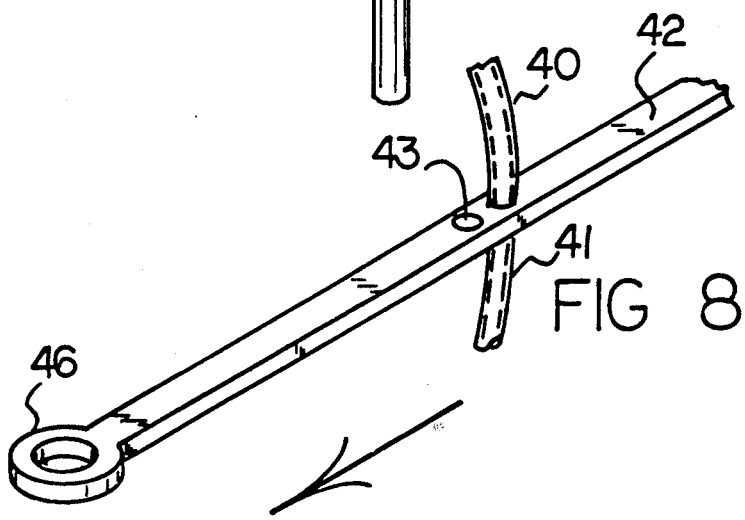
FIG. 8 is an enlarged isometric illustration of the water shutoff plate utilized by the invention.

More specifically, the patient bathing apparatus 10 of the instant invention essentially comprises a semi-cylindrical lower tank section 11 hingedly mounted to a semi-cylindrical upper tank section 12 to define a cylindrical shell for surrounding a patient positioned therewithin. Plural pairs of support legs 13 are mounted fixedly to the semi-cylindrical tank section 11 for support of the organization. The legs are typically of a height to permit alignment of the lower tank section 11 relative to a patient's bed to facilitate ease of positioning of the patient within the apparatus. The lower and upper tank sections 11 and 12 respectively include respective lower tank front wall 44 and upper tank front wall 45, each respectively coaxially providing a lower tank semi-cylindrical opening 14 and an upper tank semi-cylindrical opening 15 to define a circular opening 16 to receive a patient's head therethrough. A resilient upper tank collar 17 is mounted about a periphery of the upper tank opening 15, where optionally a similar type of collar may be provided to effect a sealing of the patient within the circular head opening 16. A plurality of parallel support legs 19 are mounted fixedly to the lower tank front wall 44 on opposed sides of the lower tank opening 14 to mount a head support web 18 therebetween to position an individual's head on the web during a bathing event. Vent plates 20 are mounted about vent plate hinges 21 to the upper tank front wall 45 that cooperate with a heated electrical grid 26 mounted adjacent a forward distal end of the upper and lower tank sections that cooperate with a fan 27 to direct heated air interiorly of the lower and upper tank sections 11 and 12 when a patient is positioned therewithin, wherein the vent plate 20 are opened to provide for drafting of the drying air directed onto the patient subsequent to a bathing event. A drain hose 22 is directed into the lower tank section 11 to permit drainage of fluid therefrom, wherein a fluid conduit 23 operative through a fluid conduit valve 24 is mounted to a connector boss 25 on the upper tank front wall 45 to direct water into the lower and upper tank sections 11 and 12. Electrical power supply cord 28 for the fan 27 is positioned at the forward distal end of the organization to provide for unobtrusive positioning of the power supply cord during use. The upper tank section 12 includes an upper tank outer and inner wall 12*a* and 12*b* respectively defining an upper tank cavity 29 therebetween, wherein a lower tank outer wall 11*a* and lower tank inner wall 11*b* define a lower tank cavity 30 therebetween to receive water within the lower and upper tank cavities 30 and 29. The lower and upper tank cavities 30 and 29 include intercommunication upper and lower tank connecting conduits 40 and 41 that are in fluid communication with the respective upper and lower tank cavities 29 and 30 to direct fluid flow from the upper tank cavity to the lower tank cavity. In this regard, reference to FIG. 8 illustrates the use of a water shutoff plate or meter plate 42 slidably mounted through the lower tank front wall 44 that includes a plurality of meter plate openings 43 that are displaced in a first position to effect the elimination of fluid flow from the upper tank connecting conduit 40 to the lower tank connecting conduit 41, wherein projection of the meter plate 42 to a second position effects alignment of the upper tank connecting conduit 40 to the lower tank connecting conduit 41 through a meter plate opening 43. A plurality of such openings in operative association with upper and lower tank conduits may be provided in a manner as illustrated in FIG. 7.

The upper and lower tank cavities 29 and 30 each include a matrix of upper and lower tank nozzles 31 and 32. The nozzles are each defined by a conical nozzle outer wall 33 rotatably mounted to a base plate 34. The conical nozzle outer wall 33 includes outer wall first and second apertures 35 and 36 diametrically directed through opposed sides of the conical nozzle outer wall 33 selectively aligned with base plate first and second apertures 37 and 38 to permit metering of fluid flow through the outer wall first and second apertures 35 and 36 permitting adjustment of water intensity and volume directed through the nozzles 31 and 32.

A support net 39 is mounted within the lower tank section 11 coextensively adjacent the upper periphery of the lower tank section 11 for support of an individual thereon permitting fluid flow and drainage through the support net 39.

Upon positioning of a patient adjacent a hospital bed and the like, the patient is transported onto a support net 39 and the upper tank section secured about the patient when the patient's head is directed through the circular head opening 16. The pivot hinge 48 joining the upper and lower tank sections together maintains alignment of the upper and lower tank sections in use. It should be further noted that the apparatus may be in operative association relative to a holding tank (not shown) that may be preheated electrically to a predetermined temperature, wherein the holding tank may utilize a pump to pressurize water to direct the pump to the tank nozzles 31 and 32. Further if desired, an exhaust pump in operative association with the drain hose 22 may be provided for enhanced ease of use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A patient bathing apparatus, comprising, a semi-cylindrical lower tank section, including an upper peripheral edge pivotally mounted to a semi-cylindrical upper tank section about a pivot hinge, and the lower tank section including a lower tank front wall in coplanar alignment with an upper tank front wall formed to the upper tank section, the lower tank front wall including a plurality of spaced parallel support legs positioned to the front wall including a head support web therebetween, and a semi-cylindrical head opening positioned medially between the support legs, and an upper tank semi-cylindrical opening directed through the upper tank front wall, wherein the lower tank opening and the upper tank opening are coaxially aligned relative to one another when the upper tank and lower tank are contiguous communication relative to one another to secure a patient's head therethrough, and a forward end with a heated electrical grid mounted within the lower tank section spaced at a remote distal end of the lower tank relative to the lower tank front wall, including a fan member mounted adjacent the heated grid to direct heated air interiorly of the lower tank section and the upper tank section subsequent to a bathing event, and at least one vent plate hingedly mounted relative to the upper tank front wall to provide venting of heated air from the heated grid through the at least one vent plate.

2. An apparatus as set forth in claim 1 including a support net, the support net mounted within the lower tank section adjacent an upper peripheral edge of the lower tank section.

3. An apparatus as set forth in claim 2 wherein the upper tank section includes an upper tank outer wall and an upper tank inner wall defining an upper tank cavity therebetween, and the lower tank section including a lower tank outer wall and a lower tank inner wall defining a lower tank cavity therebetween, and a matrix of upper tank nozzles directed through the upper tank inner wall, and a matrix of lower tank nozzles directed through the lower tank inner wall, wherein the lower tank nozzles and the upper tank nozzles are in fluid communication with the respective upper tank cavity and the lower tank cavity, and the upper tank cavity includes an upper tank connecting conduit in fluid communication with a lower tank connecting conduit to direct fluid from the upper tank cavity to the lower tank cavity, and the upper tank cavity includes a fluid hose directed into the upper tank cavity to direct fluid into the upper tank cavity.

4. An apparatus as set forth in claim 3 including a slidably mounted meter plate slidably mounted within the lower tank section positioned between the upper tank connecting conduit and the lower tank connecting conduit, the meter plate including an opening positioned between the upper tank conduit and the lower tank conduit in a first position and displaced relative to the upper tank conduit and lower tank conduit in a second position to prevent fluid flow from the upper tank conduit to the lower tank conduit, and the meter plate slidably directed through the lower tank front wall, and including a handle member exteriorly of the lower tank front wall to ease manual grasping of the meter plate.

5. An apparatus as set forth in claim 4 wherein the lower tank nozzles and the upper tank nozzles each include a conical outer wall, and the conical outer wall includes respective outer wall first apertures and conical outer wall second apertures, and the conical outer wall rotatably mounted about a base plate, the base plate including first apertures and second apertures diametrically aligned relative to one another through the base plate, wherein the conical outer wall is rotated to selectively align the outer wall first and second apertures with the base plate first and second apertures to permit selective fluid flow through each nozzle.

* * * * *